United States Patent [19]

Anderson et al.

[11] Patent Number: 4,990,183

[45] Date of Patent: Feb. 5, 1991

[54] PROCESS FOR PRODUCING STEEL HAVING A LOW CONTENT OF NITROGEN IN A LADLE FURNACE

[75] Inventors: Sara H. Anderson, Westmont, Ill.; Noël Lutgen, Igny; Jean Foulard, Ablon, both of France

[73] Assignees: L'Air Liquide, Societe Anonyme Pour L'Etude et L'Exploitation des Procedes Georges Claude, Paris, France; Liquid Air Corporation, Walnut Creek, Calif.

[21] Appl. No.: 397,976

[22] Filed: Aug. 24, 1989

[30] Foreign Application Priority Data

Aug. 29, 1988 [FR] France ..... 88 11313

[51] Int. Cl.[5] ..... G21C 5/34

[52] U.S. Cl. ..... 75/555; 75/558

[58] Field of Search ..... 75/59.3, 59.31, 51.7, 75/555, 558

[56] References Cited

U.S. PATENT DOCUMENTS

| | | | |
|---|---|---|---|
| 3,971,655 | 7/1976 | Takashima | 75/59.3 |
| 4,382,817 | 5/1983 | Vayssiere | 75/59.3 |
| 4,517,015 | 5/1985 | Inaba | 75/59.3 |

*Primary Examiner*—Peter D. Rosenberg

*Attorney, Agent, or Firm*—Oblon, Spivak, McClelland, Maier & Neustadt

[57] ABSTRACT

The present invention relates to a process for producing steel in a ladle furnace in which the molten steel is stirred by injection of an inert gas in the lower part of the furnace. According to the invention, the stirring of the bath of steel is effected by the injection of gaseous argon so as to distribute in a homogeneous manner the additives added and the metal temperature in the course of the treatment, while there is simultaneously injected liquid argon above the surface of the bath in the region of intumescence. In this way, substantially any increase in the concentration of nitrogen of the bath of steel in the course of the treatment is avoided. In some cases, and in particular when wires of the type filled with silico-calcium are employed, a reduction in the concentration of nitrogen in the bath of steel is found.

10 Claims, 1 Drawing Sheet

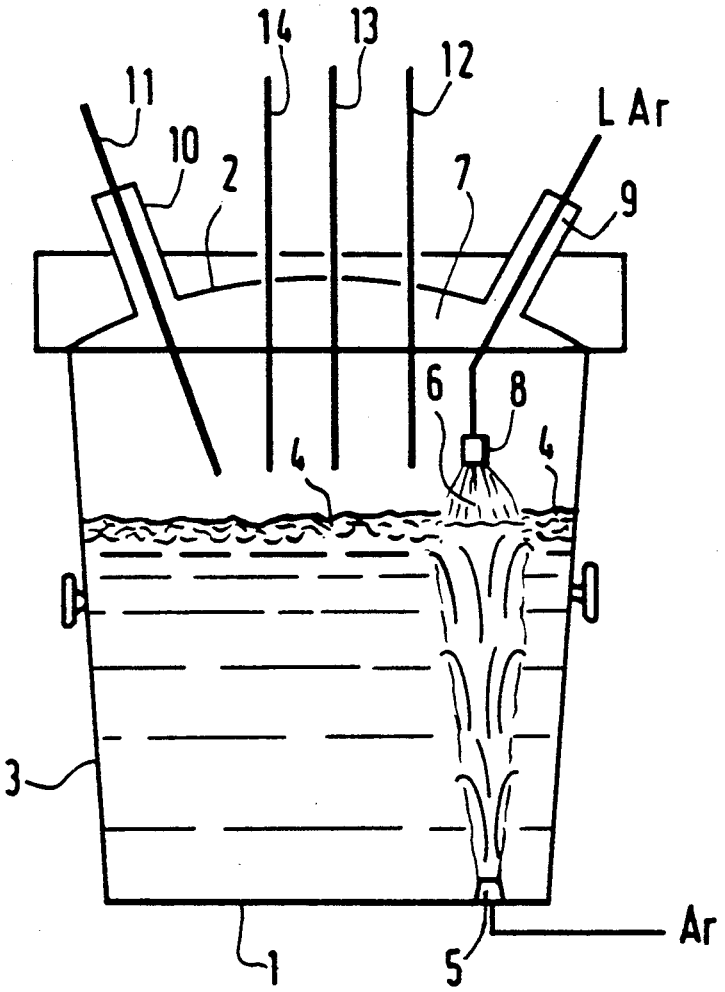
14
13
12
11
10
2
7
L Ar
9
6
8
4
4
3
1
5
Ar

PROCESS FOR PRODUCING STEEL HAVING A LOW CONTENT OF NITROGEN IN A LADLE FURNACE

The present invention relates to a process for producing steel in a ladle furnace in which the molten steel is stirred by injection of inert gas in the lower part of the furnace, the process comprising a step in which additives are added to the bath of molten metal so as to modify its composition.

An object of the present invention is to produce steels having a low content of nitrogen in a ladle furnace.

In a ladle furnace, the metal is in most cases heated by means of electrodes so as to bring it to the desired temperature or maintain it at this temperature. This produces a local overheating of the surface of the bath of metal in the region of the electrodes and this overheating is liable to result in the destruction of the refractories. This is one of the reason for simultaneously effecting a stirring or bubbling in the bath of metal by means of an inert gas, normally bottom injected, so as to homogenize the temperature of the latter.

Furthermore, ladle furnaces are employed for effecting various and massive additions of different additives in the bath of metal so as to modify the composition of the metal contained in the ladle furnace. This is another reason why it is necessary to effect a large bubbling or stirring by means of inert gas so as to homogenize the composition of the bath of metal.

Inherent with the action of electrodes in arc furnaces, be they electric arc furnaces or ladle furnaces, the atmosphere in the region of the electrodes becomes ionised. This facilitates the adsorption of nitrogen into the steel where the molten steel comes in contact with this atmosphere.

When steels are produced which have a low concentration of nitrogen, it is necessary to effect this stirring or bubbling with argon. This stirring or bubbling results in the increase in nitrogen in the steel owing to the fact that the layer of slag, which normally covers the bath of metal and prevents contact of the latter with the surrounding air, is broken in the region of the argon injection into the bath of metal this injection of argon producing an intumescence on the surface of the bath of metal. Thus the molten metal comes into contact with the surrounding air, which has been ionised due to the action of the arc.

Moreover, there are increasingly employed, in the course of the treatment of the steel in the ladle furnace, filled wires, for example silico-calcium wires, which are introduced into the bath of metal. This filled silico-calcium wire has in particular properties of deoxidizing, desulfurizing, and modifying the structure of the inclusions in the bath of metal. Other filled wires containing calcium or any other element having a high vapor pressure, such as magnesium, etc., may also be employed and have similiar properties.

The vapors of calcium or magnesium, etc. following on the decomposition of the filled wire, produce an intense formation of bubbles in the bath of metal, these vapors (bubbles) reaching the surface of the metal and moving away the slag, which still further increases the area of intumescence, i.e. the portion of the surface of the bath of metal which is uncovered by the slag. This results in a high nitrogen pick-up.

An obvious solution to this problem for a person skilled in the art would consist in purging by means of an inert gas the volume located between the surface of the bath of metal and the cover of the ladle furnace so as to eliminate the air within this volume. This could be effected by the injection of gaseous argon in the case of steel having a low concentration of nitrogen.

When a person skilled in the art attempts to apply this solution, he finds that it is practically impossible to purge this volume between the surface of the metal and the cover so as to limit the amount of nitrogen and oxygen above the bath of metal to acceptable values. Indeed, the more one increases the flow of gaseous argon for purging said volume, the greater the production of gaseous currents which, owing to the absence of a sealing of said furnaces, produces an aspiration of air which is contrary to the desired result. Inversely, a low rate of flow of argon would require several hours or several days to render said gaseous volume suitably inert.

The process according to the invention solves the problem presented, i.e. limits the nitrogen pick-up by the bath of metal in the course of treatment in the ladle furnace and in some cases reduces the concentration of nitrogen in the bath of metal relative to the initial concentration in the bath before the beginning of the treatment in the ladle furnace.

The process according to the invention comprises stirring the bath of steel by injecting gaseous argon in accordance with a rate of flow of at least 5 Nm3/h, so as to distribute in a homogeneous manner in volume the added additives, and simultaneously injecting liquid argon into the region of the intumescence on the surface of the bath of metal created in the layer of slag which normally covers said surface, the rate of flow of liquid argon being equal to at least 1.5 l/min., the jet of liquid argon being substantially directed toward the central part of the intumescence in such manner that the liquid flows substantially throughout the area of said intumescence and thus substantially avoids any increase in the concentration of nitrogen in the bath of steel in the course of the treatment of the steel in the ladle furnace, the ratio of the rate of flow of gaseous argon (expressed in Nm3) to the rate of flow of liquid argon (expressed in Nm3), being between 0.01 and 0.11.

Preferably, the flow of stirring gas (gaseous argon) will be between 5 and 40 Nm3/h, while the flow of liquid argon will be preferably between 1.5 and 8 l/min.

It has furthermore been found surprisingly that the stirring by means of gaseous argon of a bath of steel in which a filled wire containing calcium, magnesium or a metal having a high vapor tension, such as a wire filled with silico-calcium, while it protected the surface of the bath of steel uncovered with slag (hereinbefore termed intumescence) by means of liquid argon, resulted, when the values of the various parameters of gas and liquid flow were respected, in a decrease in the quantity of nitrogen in the bath of metal, although the concentration of oxygen and therefore of nitrogen, between the surface of the bath and the cover of the furnace is not nil. Such a decrease has been found even when the quantity of oxygen above the bath was 2% at the beginning of the process.

Without wishing to be tied to some theory, the applicant believes that the vapors of calcium or magnesium or metal having a high vapor pressure, produced in the bath of molten metal by the melting of the filled wire, are liable, under certain conditions, to act as a scavenging gas which results in a certain degassing of the metal and the elimination of hydrogen and nitrogen. Moreover, the liquid argon poured onto the surface of the liquid metal results in this surface being rendered correctly inert, which thus prevents any reaction with the air, in particular an intake of nitrogen, following on the generally violent stirring produced by the vapors of metal and in particular calcium.

A better understanding of the invention will be had from the following embodiments which are given by way of non-limitative examples, with reference to the figure, which is a diagrammatic sectional view of a ladle furnace for carrying out the process according to the invention. This ladle furnace comprises a ladle 1 provided with a cover 2, in which ladle is placed a molten metal 3. The bath of molten metal 3 is covered with a layer of slag 4 while a porous plug 5 is preferably provided in the lower part of the ladle furnace, through which porous plug argon is injected in the known manner. This injection of argon into the bath of metal produces by stirring or bubbling an intumescence 6, i.e. an area of the bath of metal uncovered with slag. Thus, if no other precautions are taken, the metal in this area would be in contact with the atmosphere 7 located between the surface of the bath of metal and the cover 2. According to the invention, there is simultaneously injected through the opening 9 of the cover 2, liquid argon by means of a suitable nozzle 8 provided with a diffuser, this diffuser being placed or oriented substantially toward the central part of the intumescence, the injection of liquid argon being achieved under such conditions that substantially the whole of the area of intumescence is covered with liquid argon. The bath of metal is heated by means of electrodes, 12, 13, 14. The additives are added through the opening 9.

EXAMPLE 1:

Flow of gaseous argon (stirring) : 6 Nm3/h

Flow of liquid argon : 2.6 1/min.

Ladle : 50 metric tons

Grade of steel : steel containing less that $100\times10-3\%$ of carbon and a small quantity of silicon and manganese.

Treatment time : 95'

Intake of nitrogen : with liquid argon : +4 ppm without liquid argon : +10 ppm

EXAMPLE 2:

The conditions of treatment are identical to those of Example 1, but a wire filled with CaSi is introduced in the course of the treatment.

Rate of introduction of the CaSi wire : 0.5 to 2 m/s ($N_2$) start of the treatment : 98 ppm ($N_2$) end of the treatment 85 ppm $N_2 = -13$ ppm

EXAMPLE 3:

Flow of gaseous argon (stirring) 12.7 Nm3/h

Flow of liquid argon : 6,2/min.

Ladle : 50 metric tons

Quantity of metal : 49 metric tons

| Quantity of metal | 49 metric tons | | |
|---|---|---|---|
| Grade of steel | C | Si | Mn |
| 10 - 3% | < 100 | < 700 | < 1000 |

Treatment time : 25'

Nitrogen Pick-up : with liquid argon : +3 ppm without liquid argon : +8 ppm

We claim:

1. In a process for producing steel in a ladle furnace comprising stirring the steel in a molten state by injecting inert gas in a lower part of the furnace and adding additives to the molten steel so as to modify the composition of the molten metal, the inert gas being gaseous argon injected at a rate of flow of at least 5 $Nm^3/h$ so as to distribute said additives in a homogeneous manner, and in which a layer of slag is formed on the surface of the molten steel, the invention comprising simultaneously injecting liquid argon above the surface of the bath, in a region of intumescence of said slag layer, said injection of liquid argon being at a rate of flow equal to at least 1.5 1/min., said liquid argon being directed in a jet toward a central part of the intumescence such that the liquid argon so injected flows over substantially the whole of area of said intumescence, thereby reducing any increase in the nitrogen content of said steel, wherein the ratio of the flow of gaseous argon (expressed in $Nm^3$) to the flow of liquid argon (express in $Nm^3$) is between 0.01 and 0.11.

2. Process according to claim 1, wherein the rate of flow of said gaseous argon is between 5 and 40 Nm3/h.

3. Process according to claim 1, wherein the flow of said liquid argon is between 1.5 and 8 1/min.

4. Process according to claim 1, wherein the additive contains an element selected from the group consisting of calcium, magnesium and any other element having a high vapor pressure at usual temperatures of treatment of steel in a ladle.

5. Process according to claim 1, wherein the additive is silico-calcium.

6. Process according to claim 4, wherein the additive is incorporated in a wire introduced in the bath of molten metal at a rate of between 0.5 and 2 m/s.

7. Process according to claim 5, wherein the additive is incorporated in a wire introduced in the bath of molten metal at a rate of between 0.5 and 2 m/s.

8. Process according to claim 1, preceded by a step of transferring the steel to a ladle while protecting the surface of the molten steel with carbon dioxide in the form of snow.

9. Process according to claim 1, wherein the ladle furnace has a cover, said Process comprising starting the injection of the liquid argon at the latest when the ladle furnace is covered with said cover.

10. Process according to claim 9, comprising stopping the injection of liquid argon after having stopped said stirring.

* * * * *